US006023906A

United States Patent [19]

Folkersen

[11] Patent Number: 6,023,906

[45] Date of Patent: Feb. 15, 2000

[54] METHOD FOR SEALING PITCHED ROOFS

[76] Inventor: Jonny Folkersen, 1036 Washington St., Braintree, Mass. 02184

[21] Appl. No.: 09/032,202

[22] Filed: Feb. 27, 1998

[51] Int. Cl.[7] ..... E04D 1/00

[52] U.S. Cl. ..... 52/746.11; 52/746.1; 52/748.1; 52/409; 52/518; 52/DIG. 16

[58] Field of Search ..... 52/746.1, 746.11, 52/747.1, 748.1, 748.11, DIG. 16, 741.1, 409, 518

[56] References Cited

U.S. PATENT DOCUMENTS

| | | | |
|---|---|---|---|
| 1,418,377 | 6/1922 | Jaynes | 52/746.11 X |
| 2,044,782 | 6/1936 | Harshberger | 52/518 X |
| 2,144,168 | 1/1939 | Sherriff | 52/746.11 X |
| 2,226,239 | 12/1940 | Elmendorf | 52/409 |
| 2,241,514 | 6/1941 | Hardy | 52/746.11 |
| 2,394,380 | 2/1946 | Herbes | 52/748.11 |
| 4,825,616 | 5/1989 | Bondoc et al. | 52/748.1 X |
| 4,932,171 | 6/1990 | Beattie | 52/746.11 X |
| 5,512,118 | 4/1996 | Davis et al. | 52/746.11 X |

*Primary Examiner*—Beth Aubrey
*Assistant Examiner*—Brian E. Glessner
*Attorney, Agent, or Firm*—Robert W. Nelson

[57] ABSTRACT

This invention is a method for sealing pitched shingled roofs. The object is to minimize the cost associated with sealing a roof against standing water such as the case with an ice dam. The method involves placing a continuous waterproof membrane over existing roofing shingles and placing the new shingles on the membrane. The membrane is self adhesive on one side, which is used to adhere to the existing shingles. It is further durable enough to withstand the forces between layers of shingles and thin enough so not to present torque problems with the fasteners used to affix the new shingles to the roof substrate.

17 Claims, 5 Drawing Sheets

METHOD FOR SEALING PITCHED ROOFS

This invention is a method for sealing roofs against water leakage when an ice dams accumulates on the roofs. The method comprises placing a membrane upon an existing roof and then placing a new roof upon the membrane. This method alleviates the need to remove the existing shingles to solve an ice dam problem. The existing shingles are left in place and only need to be removed when all the shingles are stripped from the roof, which is normally when the second layer of shingles fails. The invention is the use of a specific membrane between layers of roofing shingles.

BACKGROUND OF THE INVENTION

Many structures in the colder climates face water damage due to the build up of ice dams on their roofs during the winter months. Snow builds up on the roof and creates an insulating layer between the outside environment and the roof. As residual heat escapes from the structure through the roof, the snow in the proximity of the roof begins to melt and the water runs down the roof under the snow as is the case in a rain storm. Normally, this water leaves the roof by passing over the eave and off the roof.

Under certain cold conditions, the roof areas above the eaves become cold because they are not heated by the residual heat escaping from the structure. The water then freezes as it contacts the cold roof area over the eaves. This in turn causes ice to build up on the roof over the eaves, which in turn forms a barricade or an ice dam. The water behind the dam and on the roof remains in a liquid form due to the residual heat escaping from the structure. Pitched shingled roofs are constructed from overlapping shingles, therefore the standing water behind the dam may seep under the shingles and into the structure causing water damage.

Most overlaid shingled roofs are not designed to seal against the standing water caused by ice dams. They are designed, through their overlaid placement, to seal against water running off the roof. When water stands on a pitched shingled roof, the water seeps under the shingles, through the roof substrate and into the structure.

There are construction methods used to protect structures from damage caused by water standing on their pitched shingled roofs. These include placing low friction roof elements on the eaves, so the ice slides off the roof. Some systems use electric heaters placed upon the eaves to melt the ice dams or to keep them from forming. Another way to prevent water damage to the structure is by placing a waterproof membrane on the substrate and under the shingles. In the event an ice dam occurs the membrane seals the structure from the standing water preventing water from contacting the substrate.

When an existing roof leaks due to ice dams, the method to fix it is rather extensive. The shingles are stripped from the roof so that a membrane may be placed upon the substrate. The membrane generally used is an adhesive membrane that adheres to the substrate. The industry standard is a 0.040" waterproof membrane. The membrane is adhered to the substrate and the shingles are laid, in overlapping fashion, on the membrane. They are then affixed to the substrate. This requires disposing roofing shingles that themselves may be functional and placing new shingles on the roof.

A problem exists in many colder climates because many structures were constructed without any ice dam prevention measures or measures to prevent damages caused by standing water on the roofs. This problem was not noticed for several years in many of the northern areas because the conditions had not been right to form ice dams for several years. Recently, ice dams have formed and these structures have suffered considerable damage as a result of water leaking through their roofs and into the structures.

This problem has been compounded in larger structures such as condominiums. Many of the condominiums are fairly large structures that were built economically. In some cases, the trusses flex slightly, which in turn causes the shingles to crack. The stressing may also cause the flashing to leak due to being misplaced or due to the adhesion on the flashing becoming undone. The roof then leaks more often and the volume of leaking water in the case of an ice dam increases.

The only way to solve the ice dam problem on many of these structures is by placing a waterproof membrane upon the roof. The methods used to date consist of placing the membrane directly on the roof substrate and under the roofing shingles as set forth above. This requires removing the existing roofing shingles, placing the membrane on the substrate and then placing new roofing shingles on the membrane. The reason for removing the existing roof is that none of the membrane or shingle manufacturers have found a suitable method for placing a second membrane on the existing shingles and placing the new roofing shingles on the second membrane. The membrane must be compatible with flashing components, otherwise, the standing water may seep around their junction, through vertical roof components and into the structure. The membrane must also be strong enough to withstand the forces exerted through the shingles. The shingles do not lay flat, so stress is created; should the membrane tear under the stress, the roof will be susceptible to ice dam damage.

An additional problem exists with disposing of asphalt roofing shingles. Stripping a roof creates an enormous amount of waste that may be considered hazardous or require special disposal techniques given the municipality. Stripping a roof to replace or install a membrane creates the waste disposal problem. In addition, if the first membrane is adhered to the substrate, replacing the roof may damage an otherwise good substrate. Therefore, there exists a need for a method to waterproof roofs against standing water without stripping the existing shingles and without causing damage to the substrate.

The applicant has found a membrane that can be used on a first layer of existing roofing shingles and under a new layer of shingles. This allows the new roofing shingles to be replaced without the expense of removing the existing shingles. This procedure saves on the cost of replacing the roof. At present, the applicant has found that many roofs are leaking after about ten years when in fact they should be lasting for about thirty years. After thirty years, most people expect to place a second layer of shingles on the first layer and completely strip the roof after a total of sixty years. This method of roofing saves the first layer of shingles, so the roof should not need to be stripped for approximately forty years from the date it was first installed. Further, the applicant has found that the membrane may be placed over existing flashing to assure a waterproof roof without the cost of replacing existing flashing. The membrane is durable enough to withstand the aforementioned stresses in the roof and by movement of the trusses.

SUMMARY

This invention is a method for waterproofing pitched, shingled roofs comprising placing a membrane between the existing roofing shingles and new roofing shingles. The membrane is a flexible, self adhesive material that is able to withstand the stresses placed on the roof It is placed on the existing roof in such a way as to extend over the eaves of a roof and back upon the roof a distance such that it is under any water that may stand upon the roof, which is dependent upon the weather conditions and the pitch of the roof. The membrane is placed over existing flashing so minimal work is required to waterproof the roof. New flashing and drip edges are installed to divert water from the structure.

The basis for the applicants invention is the use of a given membrane used on existing shingles on a pitched roof. The membrane is then covered by a layer of roofing shingles. The applicant has found that nobody in the roofing industry has been able to combine a waterproof membrane between layers of shingles on a pitched roof.

DETAILED DESCRIPTION OF THE INVENTION

Figure 1:
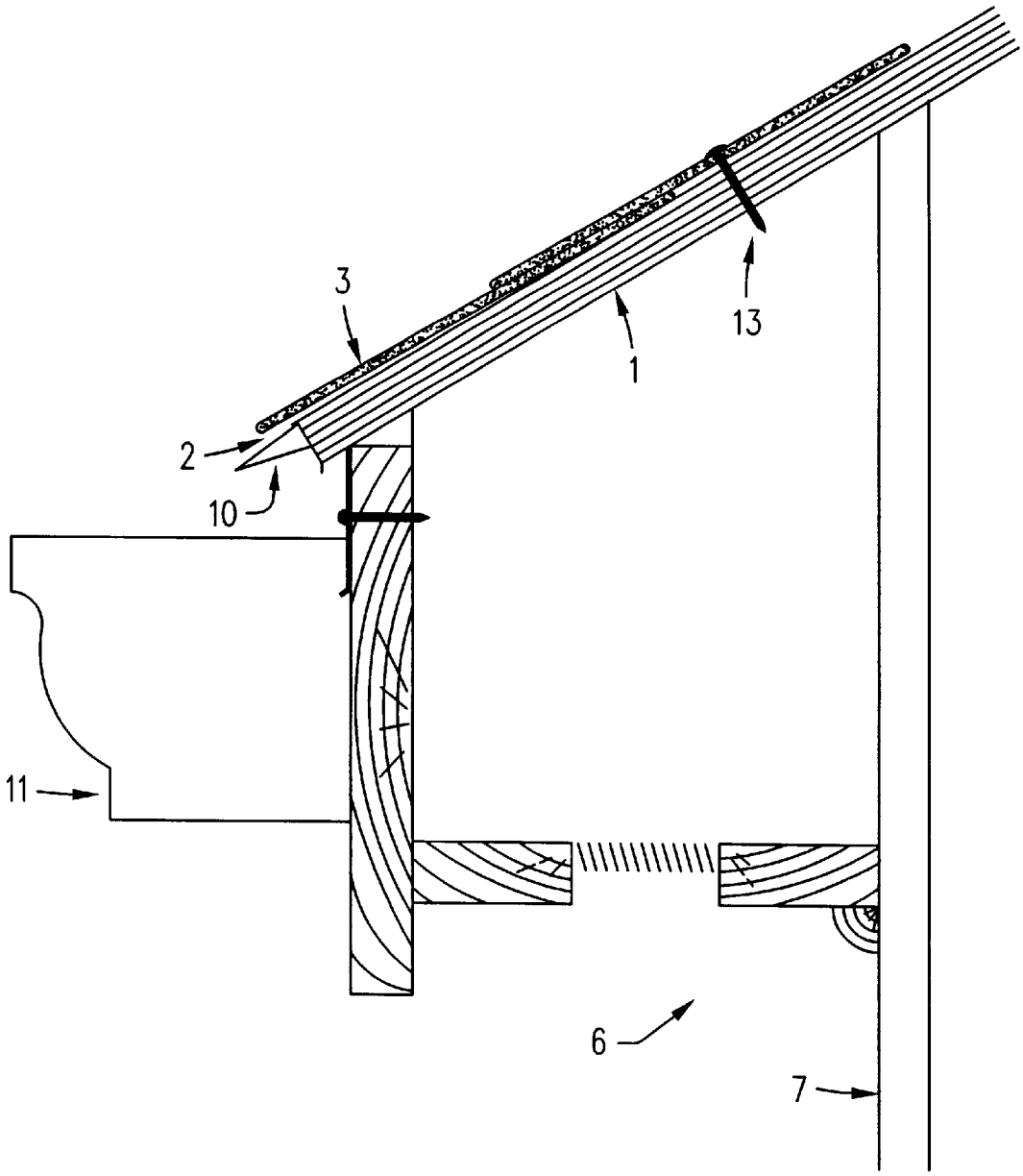
FIG. 1 is a cut out view of an existing roof prior to the application of a second layer of roofing shingles being applied as depicted by the applicant. The figure primarily depicts the area over the eave.
Figure 2:
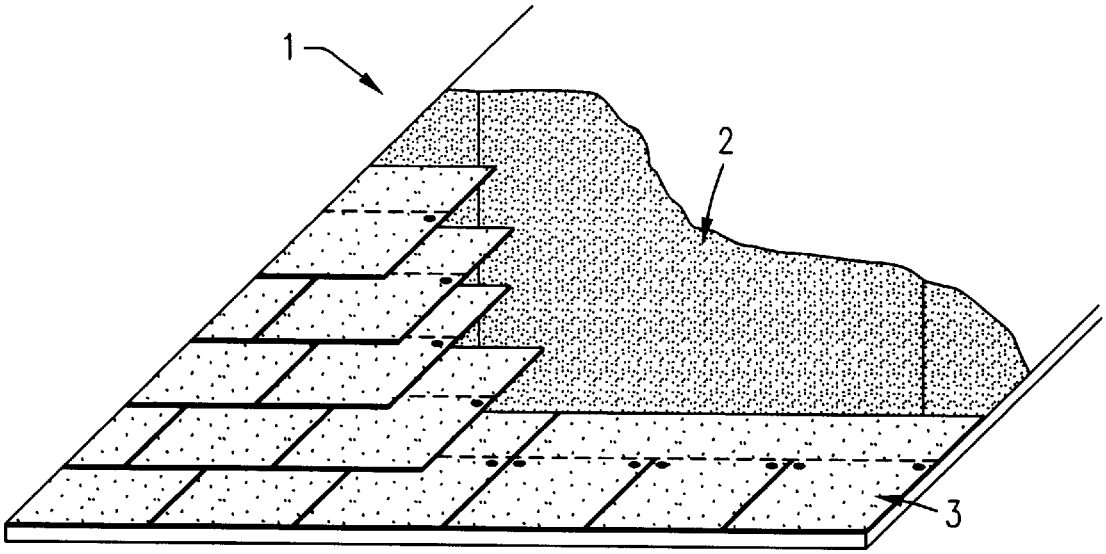
FIG. 2 is a view the layers comprising a roof.

This invention is a method for waterproofing an existing roof without the need to remove the existing first layer of roofing shingles. A standard roof is depicted in FIG. 1. Substrate 1 is generally a rigid sheet material such as plywood or press board that is attached to the rafters of the structure. Membrane 2 is affixed to substrate 1, generally with the use of staples. Membrane 2 is a thin material such as tar paper, which is good for repelling water, but does not act as a good waterproof membrane in the event water stands on the roof. Many roofs were constructed without any membrane between shingles 3 and substrate 1. Roofing shingles 3 are laid in an overlapping fashion as depicted in FIG. 2 on membrane 2 and fastened to substrate 1 by means of fasteners 13. Shingles 3 are generally a semi-rigid shingle made from an asphalt base. They generally have an adhesive substance on their underside to adhere to the shingles they overlap. This adhesion is not adequate to from a waterproof seal against standing water. Additionally, membrane 2 does not have to have very much structural integrity because it lays directly on substrate 1, which is a flat surface and therefore, little or no forces act to stress it.

FIG. 2 depicts the overlapping of shingles 3, on membrane 2 and affixed to substrate 1. The overlapping of shingles 3 provides a waterproof for running water, but does not provide for a waterproof roof in the event of standing water.

The roof extends past the vertical external wall 7 of the structure to form eave 6. Eave 6 coupled with drip edge 10 diverts water from dripping on the structure. In the embodiment shown, the water falls into gutter 11. Drip edge 10 is usually an aluminum strip placed beneath shingles 3 and membrane 2 and above substrate 1 to divert water from substrate 1.

Figure 3:
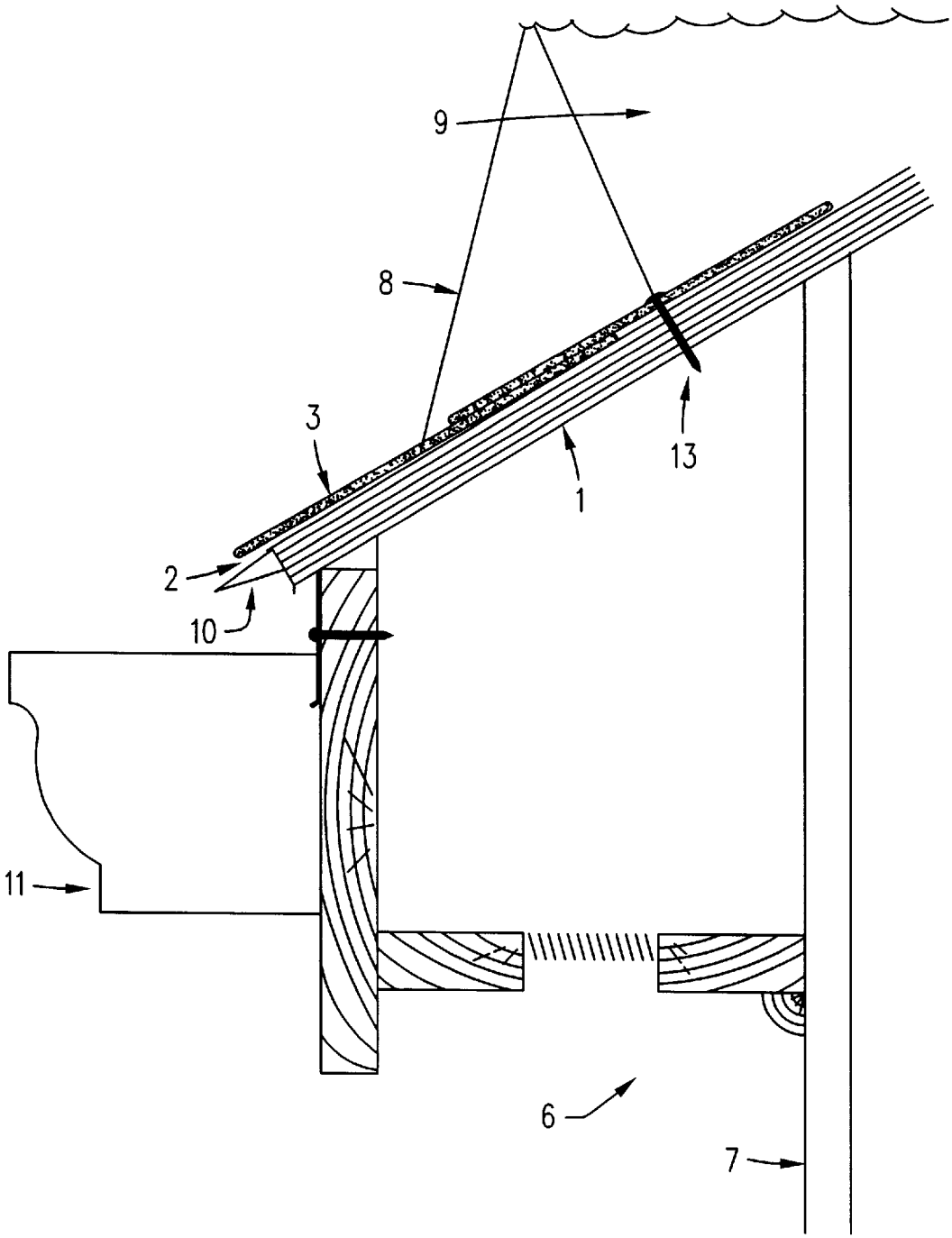
FIG. 3 is a cut out view of the eave depicted in FIG. 1 showing the build up of an ice over the eave.

FIG. 3 depicts the formation of an ice dam on the roof over eave 6. In cold, wintery conditions, snow may build up on shingles 3. The snow may then act as an insulating layer by insulating residual heat from escaping from the structure to the atmosphere. The structure is heated during cold conditions, and the heat rises through substrate 1 and to shingles 3. When enough energy is transferred to the snow on shingles 3, the snow begins to melt and the water proceeds to run off the roof as it would during a rain storm.

The area of the roof above eave 6 does not receive any significant residual heat from the structure. When the temperature outside the structure is below freezing, the water from the melting snow begins to freeze as it passes over eave 6. Depending upon the outside temperature and the pitch of the roof, the water may not have enough time to crystallize to ice before it falls off the roof. When the temperature is well below freezing or the pitch in the roof is small, the water from the melting snow crystallizes to shingles 3 above eave 6 before it can fall off the roof. As more water freezes over eave 6, ice dam 8 forms on shingles 3 above eave 6. The area of the roof above and behind wall 7 will now have standing liquid water 9 on it. The depth of the water and the extent to which the water extends up the roof depends upon the height of ice dam 8 and the pitch of the roof.

The standing water now may seep under shingles 3 and through membrane 2, if membrane 2 is present. Substrate 1 has gaps where the sheets abut one another, so the water may seep through these gaps and into the structure, including into wall 7. In some instances, it will soak through substrate 1 and into the structure. Once the water is in the structure, it damages the building materials used in the structure.

One way to keep water from seeping through shingles 3, membrane 2, substrate 1 and into the structure is by removing shingles 3 and membrane 2. Membrane 2 is then replaced on the lower section of the roof with a waterproof membrane. Any water that seeps through shingles 3 is unable to seep through membrane 2 to substrate 1 and into the structure. This procedure requires removing and disposing of shingles 3 and then replacing shingles 3 after new membrane 2 is laid on substrate 1.

Figure 4:
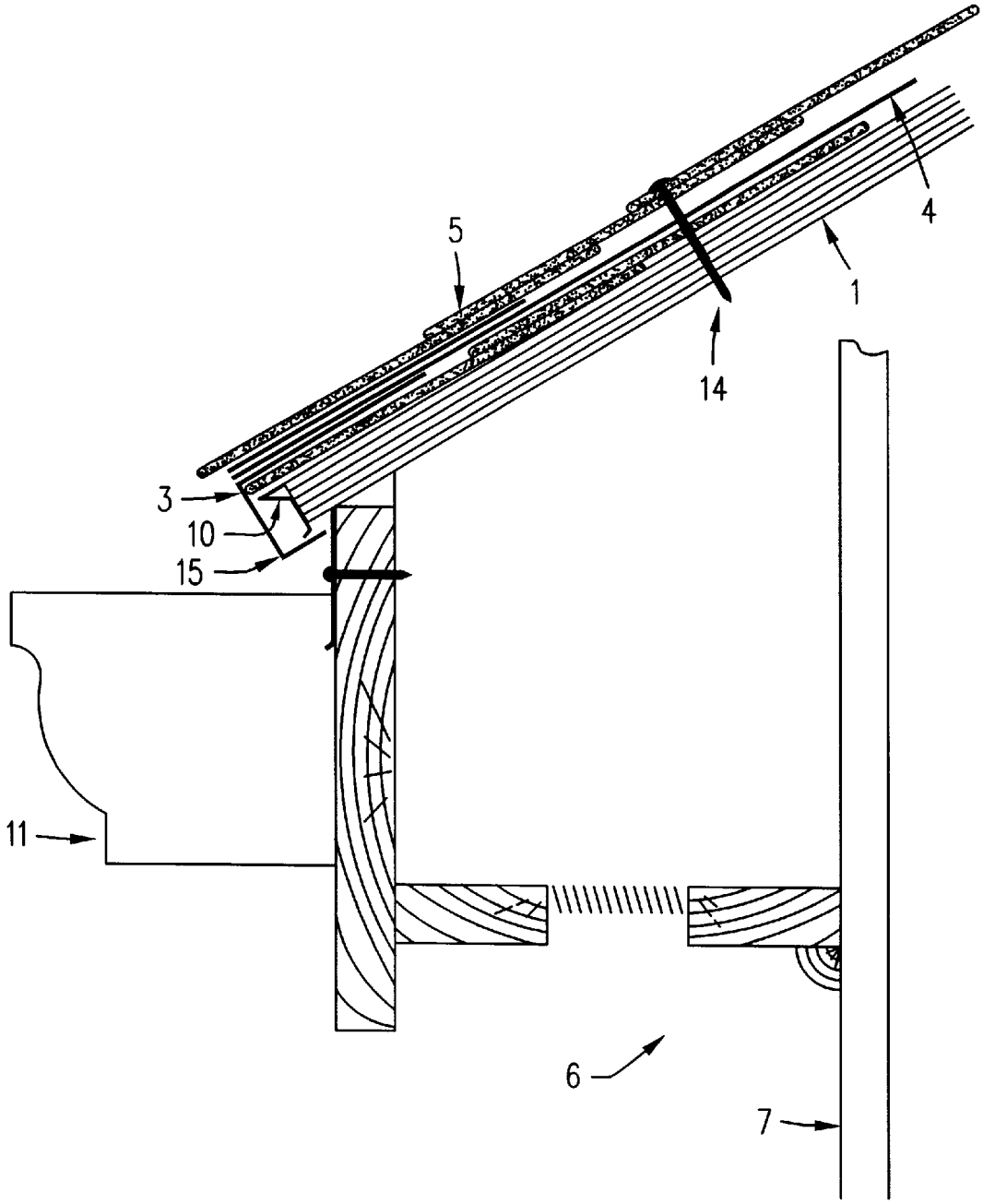
FIG. 4 is a cut out view of a roof that has the applicant's waterproofing method applied.

The applicant's method for sealing an existing pitched roof is depicted in FIG. 4. Rather than removing shingles 3, second membrane 4 is placed on shingles 3 and new shingles 5 are placed upon membrane 4. In the event ice dam 8 forms over eave 6 (as depicted in FIG. 3), standing water 9 may penetrate through new shingles 5, but it will go no further toward substrate 1 than second membrane 4 due to the waterproof characteristics of second membrane 4, which will be discussed in detail below.

The applicant's method of sealing roofs saves the existing roof disposal for a later date, approximately thirty years in the future. Present waterproofing methods require existing shingles 3 to be stripped from substrate 1 and disposed. Depending on membrane 2, damage may be done to substrate 1 during stripping, requiring replacement or repair to substrate 1. If membrane 2 is non existent, or is a paper material, little or no damage will be done to substrate 1. The applicant's method does not require removing existing shingles 3. New shingles 5 are placed over shingles 3. When the time comes to replace new shingles 5, shingles 3 may be removed at that time; generally new shingles 5 will last for thirty years.

Second membrane 4 is a thicker membrane than would normally be used on pitched roofs and in fact was manufactured to seal flat roofs. Industry standard membranes are a 0.04 inch sheet, usually a polymer. The membrane found by the applicant to work for this method is a 90 to 130 mil membrane known by the trade name of TOP SEAL manufactured by the NEI corporation of Brentwood, N.H. The membrane is self adhering on one side, which is laid down facing existing shingles 3. Any membrane with the waterproof, flexibility, and integrity similar to the TOP SEAL product will work in this invention.

Membrane 4 used by the applicant has the following characteristics. It is a self adhesive rubberized asphalt membrane with a fiberglass core and a granular surface, the granular surface being the nonadhesive surface facing away from shingles 3. The fiberglass adds to the integrity and may be replaced with any material with enough integrity to withstand roof forces between layers of shingles. The granular surface protects from ultra violet radiation and is not a requirement for membrane 4 as it is placed under new shingles 5. Membrane 4 is approximately 90 to 130 mils in thickness. The tensile strength of the product used by the applicant is 68 pounds per inch; water vapor transmission is 0.02 gallons per hour per square meter; the peel adhesion is 19 pounds per inch. It is able to withstand 100 mile per hour wind driven rain and has a wind uplift resistance of −28 pounds per square foot and static pressure of −55 pounds per square foot. The above specification describes an embodiment of the membrane found by the applicant to be the best mode for using this invention. Other similar embodiments now apparent to those skilled in the art will also serve as embodiments of the applicant's invention.

The embodiment of membrane 4 used by the applicant has a small adhesive strip on the non adhesive or granular side. Membrane 4 is adhered to the roof such that the adhesive strip faces away from shingles 3 and is higher in elevation than the edge of membrane 4 without the adhesive strip. The purpose of the strip to provide an overlapping continuous membrane. Therefore, the first strip of membrane 4 is laid upon the roof close to the eave. Subsequent membrane strips are placed such that their adhesive side overlaps the aforementioned adhesive strip. This assures a continuous overlapping membrane when it is made from strips.

Membrane 4 must be laid down in a continuous sheet on shingles 3. Membrane 4 has an adhesive side, which is laid down facing shingles 3. If there are any gaps in membrane 4, water may seep through shingles 3 and into the structure. In cases where several sheets of membrane 4 are required to be placed on shingles 3, the sheets must overlap such that the adhesive side of the upper sheet is placed on the non adhesive side of the lower sheet. This is to assure a consistent seal in membrane 4.

The added thickness of second membrane 4 provides many advantages when used in this application. Membrane 4 provides some resilience should the trusses within the structure shift or move. This helps to protect new shingles 5 from being damaged. Additionally, as new fastener 14 is placed through new shingles 5 and the underlying layers into substrate 1, the thicker membrane along with its adhesion acts as a seal to assure no water will seep through the hole made by fastener 14. Membrane 4 must be strong enough to withstand the forces between shingles, including the forces presented by workers during construction. In the embodiment used by the applicant, he wraps a new drip edge 15 around substrate 1 and over any existing drip edge. The drip edge extends under new membrane 4 to assure water that may stand on the roof will not seep under it.

Figure 5:
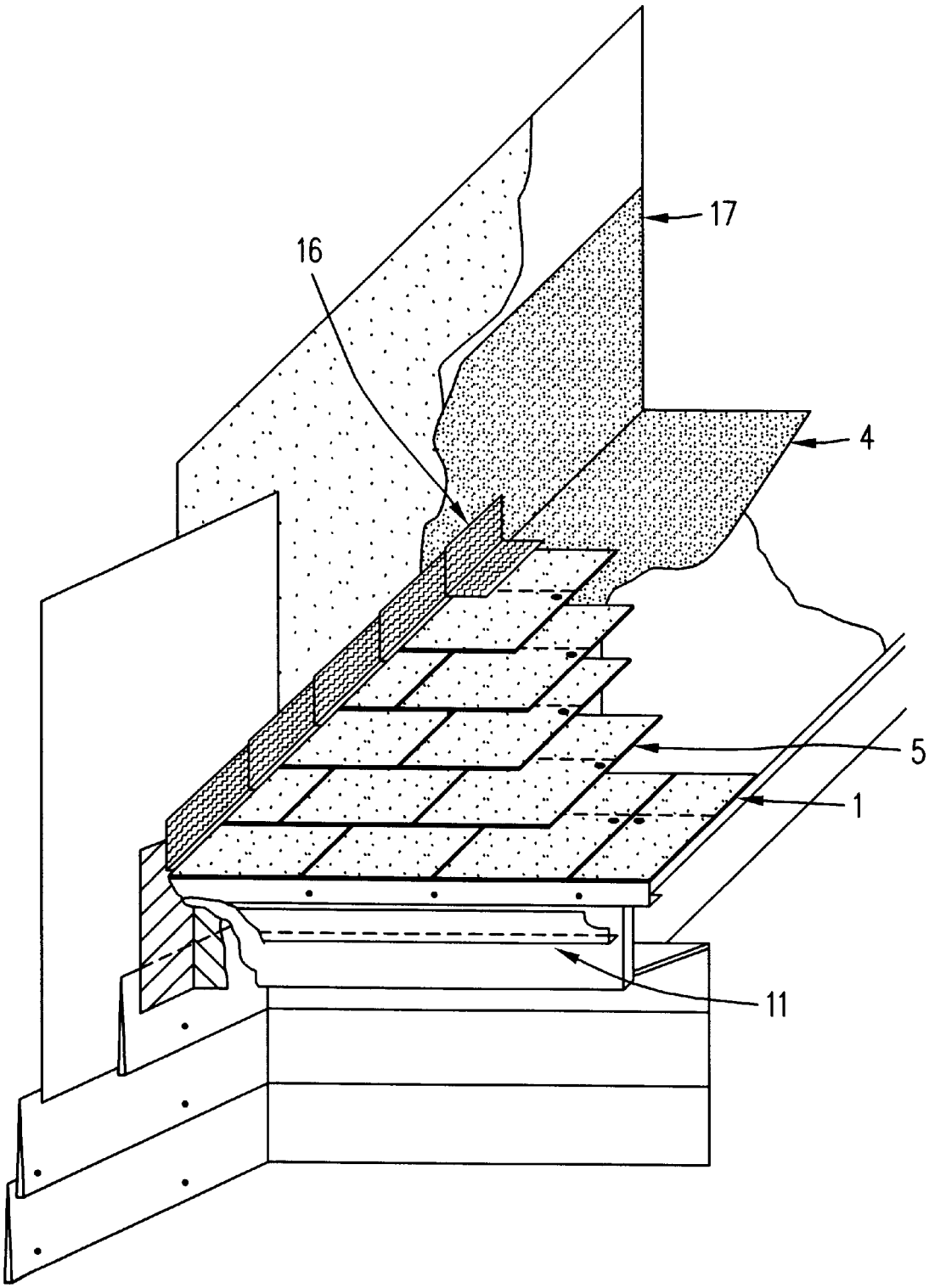
FIG. 5 is a view of an embodiment of the applicant's invention used to seal a junction with a vertical wall.

The applicant further waterproofs the roof by sealing vertical walls, vents, skylights and the like which contact the roof and may be subject to standing water. FIG. 5 depicts an embodiment of the applicant's invention used to seal a roof which has an adjoining vertical wall 17. The applicant extends second membrane 4 to the vertical or inclined abutting area and extends membrane 4 up a distance above the level of any standing water. Second membrane 4 is placed over existing flashing and under any fascia or other trim or exterior surface. Step flashing 16 is woven into new shingles 5 along vertical incline 17 and the vertical section of step flashing 16 is affixed to vertical incline 17. The object is to remove the exterior finish without removing existing flashing. The applicant has found that membrane 4 as described will seal over existing flashing. In the embodiment depicted in FIG. 4, step flashing 16 is woven into new shingles 16 as they are placed on second membrane 4.

Use of such membranes has been practiced on flat roofs, but its use on pitched shingled roofs has not been used in the roofing industry. The applicant has been told that use of membranes would not work between layers of roofing shingles on a pitched roof. The applicant has found the correct membrane and method to apply second membrane 4 between shingles 3 and new shingles 5. The membrane used by the applicant is specifically manufactured for use in sealing flat roofs where standing water is a common occurrence. It is much thicker than membranes presently used as depicted by membrane 2 and waterproof verses water resistant. One of the reasons this method has not been practiced for sealing roofs is that the use of a membrane between layers of shingles would most likely tear due to the forces acting between the overlapping shingles. The applicant has found that this membrane has the durability to withstand the forces between the shingles. Additionally, the applicant has found that the membrane described is not too thick as to create torque upon fasteners 14 should a force normal to fasteners 14 be present through new shingles 5.

While the applicant has described embodiments for his method of sealing existing pitched shingled roofs, other embodiments of the applicant's invention will become evident to those skilled in the art.

What is claimed is:

1. A shingled, pitched roof comprising:

a substrate;

a first layer of shingles affixed to said substrate;

a waterproof membrane positioned adjacent at least a portion of said first layer of shingles;

a second layer of shingles positioned adjacent said waterproof membrane and affixed to said substrate.

2. The roof of claim 1 wherein said membrane has an adhesive side and a non adhesive side and wherein said adhesive side is adjacent said first layer of shingles.

3. The roof of claim 1 wherein said membrane is a rubberized asphalt sheet having a tensile strength of about 68 pounds per inch.

4. The roof of claim 1 wherein said roof has existing flashing and wherein said membrane covers at least a portion of said existing flashing.

5. The roof of claim 1 wherein said membrane forms a continuous sheet.

6. The roof of claim 1 wherein said membrane is a rubberized sheet.

7. The roof of claim 1 wherein said membrane has a tensile strength of about 68 pounds per inch.

8. The method of claim 1 wherein said roof has a second membrane located between said substrate and said existing shingles.

9. A method for sealing a pitched, shingled roof wherein said pitched, shingled roof has a roof substrate with at least one layer of existing shingles attached thereto, said existing shingles having a first surface and a second surface wherein said first surface faces said roof substrate and said second surface faces opposite said first surface; said method comprising:

affixing a waterproof membrane to at least a portion of said existing shingles second surface; and affixing a second layer of shingles to said membrane.

10. The method of claim 9 wherein said waterproof membrane has an adhesive side and a non adhesive side and wherein said affixing a waterproof membrane comprises adhering said adhesive side of said waterproof membrane to at least a portion of said existing shingles second surface.

11. The method of claim 9 wherein said membrane is a water proof, self adhesive, rubberized asphalt sheet having a tensile strength of about 68 pounds per inch.

12. The method of claim 9 wherein said roof has a second membrane located between said substrate and said layer of existing shingles.

13. The method of claim 9 wherein said membrane is self adhesive.

14. The method of claim 9 wherein said membrane is a rubberized material.

15. The method of claim 9 wherein said membrane has a tensile strength of about 68 pounds per inch.

16. A method for sealing a pitched shingled roof wherein said pitched shingled roof has at least one layer of existing shingles attached to a roof substrate, said existing shingles having a first surface and a second surface wherein said first surface faces said roof substrate and said second surface faces opposite said first surface; said method comprising:

providing a waterproof membrane, said waterproof membrane having an adhesive side and a non adhesive side, said waterproof membrane having a tensile strength of about 68 pounds per inch;

adhering said adhesive side of said membrane to at least a portion of said existing shingles second surface;

fastening a second layer of shingles to said membrane nonadhesive side with a plurality of fasteners, wherein said fasteners extend through said second layer of shingles, through said membrane, through said layer of existing shingles, and into said roof substrate.

17. The method of claim 16 further comprising attaching flashing to said existing shingles second surface.

* * * * *